US011186965B2

(12) United States Patent
Yoon et al.

(10) Patent No.: US 11,186,965 B2
(45) Date of Patent: Nov. 30, 2021

(54) EXCAVATOR PEDAL VALVE

(71) Applicant: YOUNG DONG TECH CO., LTD., Changwon-si (KR)

(72) Inventors: Chan Heon Yoon, Changwon-si (KR); Chul Ki Song, Jinju-si (KR)

(73) Assignee: YOUNG DONG TECH CO., LTD., Changwon-si (KR)

( * ) Notice: Subject to any disclaimer, the term of this patent is extended or adjusted under 35 U.S.C. 154(b) by 704 days.

(21) Appl. No.: 16/078,738

(22) PCT Filed: Feb. 9, 2018

(86) PCT No.: PCT/KR2018/001734
§ 371 (c)(1),
(2) Date: Aug. 22, 2018

(87) PCT Pub. No.: WO2018/164383
PCT Pub. Date: Sep. 13, 2018

(65) Prior Publication Data

US 2021/0214917 A1 Jul. 15, 2021

(30) Foreign Application Priority Data

Mar. 7, 2017 (KR) ..... 10-2017-0028867

(51) Int. Cl.
*E02F 9/20* (2006.01)
*E02F 9/22* (2006.01)
*G05G 1/44* (2008.04)

(52) U.S. Cl.
CPC ..... *E02F 9/2004* (2013.01); *E02F 9/2267* (2013.01); *G05G 1/44* (2013.01)

(58) Field of Classification Search
None
See application file for complete search history.

(56) References Cited

U.S. PATENT DOCUMENTS

2013/0092858 A1* 4/2013 Sakatani ..... E02F 9/2004 251/231
2018/0058033 A1* 3/2018 Higuchi ..... E02F 3/384

FOREIGN PATENT DOCUMENTS

CN 102741773 A 10/2012
EP 3412835 A1 * 12/2018 ..... E02F 9/00
(Continued)

OTHER PUBLICATIONS

Chinese Office Action for related CN Application No. 201880001382.6 dated Apr. 29, 2020 from Chinese Patent Office.

*Primary Examiner* — Vicky A Johnson
(74) *Attorney, Agent, or Firm* — Paratus Law Group, PLLC

(57) ABSTRACT

An excavator pedal valve, including: a body part in which a flow path for controlling forward and backward traveling is formed in a front and a rear of an interior in a vertical direction; a cam part provided at an upper end of the body part and provided so as to be rotatable in a forward direction and a rear direction with respect to a central axis by driving of a pedal; a rod part provided in each of a front lower portion and a rear lower portion of the cam part to apply force in a vertical direction along the flow path of the body part; and a return elastic part provided in a lower portion of the rod part to return the rod part upward. A rotation part is formed at a lower portion of the cam part having a contact surface with the rod part.

2 Claims, 5 Drawing Sheets

(56) References Cited

FOREIGN PATENT DOCUMENTS

| | | | | |
|---|---|---|---|---|
| JP | H08-159331 | A | | 6/1996 |
| JP | 2004-211375 | A | | 7/2004 |
| JP | 2007-132121 | A | | 5/2007 |
| JP | 2009-102828 | A | | 5/2009 |
| JP | 2011-064064 | A | | 3/2011 |
| JP | 2011064064 | A | * | 3/2011 |
| KR | 20-0140526 | Y1 | | 4/1999 |
| KR | 10-2012-0095998 | A | | 8/2012 |

* cited by examiner

EXCAVATOR PEDAL VALVE

CROSS REFERENCE TO PRIOR APPLICATIONS

This application is a National Stage Patent Application of PCT International Patent Application No. PCT/KR2018/001734 (filed on Feb. 9, 2018) under 35 U.S.C. § 371, which claims priority to Korean Patent Application No. 10-2017-0028867 (filed on Mar. 7, 2017), which are all hereby incorporated by reference in their entirety.

TECHNICAL FIELD

The present invention relates to an excavator pedal valve, and more particularly, to a pedal valve provided at a lower portion of a pedal capable of controlling forward and backward movement of an excavator to control the forward and backward movement of the pedal by applying pressure to a front and a rear of the pedal.

BACKGROUND ART

In general, an excavator pedal valve is configured in such a manner that an excavator moves forward when pressing a pedal forward and the excavator moves backward when pressing the pedal backward.

In this case, the pedal valve has a cam that can rotate back and forth at an upper portion thereof, and hydraulic pressure is controlled by applying pressure to a rod at a lower portion of the rod due to forward and backward rotation of the cam. As illustrated in FIG. 1, considerable pressure and friction are generated on a contact surface of the cam and the rod, causing a failure.

Therefore, a technique capable of flexibly coping with the frictional pressure generated on the contact surface between the cam and the rod is required.

In this regard, referring to the related art, a remote control valve for driving a crawler excavator is disclosed in Korean Utility Model Registration No. 20-0140526, which relates to a technique capable of preventing a quick operation of a valve by pedal operation and has a problem that the above problem cannot be solved.

SUMMARY OF THE INVENTION

Accordingly, the present invention is contrived to solve the problem in the related art and an object of the present invention is to provide an excavator pedal valve capable of preventing damage to a frictional surface of a cam part and a rod part.

Objects to be solved by the present invention are not limited to the aforementioned objects and other unmentioned objects to be solved by the present invention will be clearly understood by those skilled in the art from the following description.

The excavator pedal valve according to the present invention is configured to include: a body part in which a flow path for controlling forward and backward traveling is formed in a front and a rear of an interior in a vertical direction; a cam part provided at an upper end of the body part and provided so as to be rotatable in a forward direction and a rear direction with respect to a central axis by driving of a pedal; a rod part provided in each of a front lower portion and a rear lower portion of the cam part to apply force in a vertical direction along the flow path of the body part; and a return elastic part provided in a lower portion of the rod part to return the rod part upward, and a rotatable rotation part is formed at a lower portion of the cam part having a contact surface with the rod part.

An excavator pedal vale according to the present invention can prevent abrasion by minimizing frictional force of a frictional surface between a cam part and a rod part of a pedal valve.

DETAILED DESCRIPTION

The excavator pedal valve according to the present invention is configured to include: a body part in which a flow path for controlling forward and backward traveling is formed in a front and a rear of an interior in a vertical direction; a cam part provided at an upper end of the body part and provided so as to be rotatable in a forward direction and a rear direction with respect to a central axis by driving of a pedal; a rod part provided in each of a front lower portion and a rear lower portion of the cam part to apply force in a vertical direction along the flow path of the body part; and a return elastic part provided in a lower portion of the rod part to return the rod part upward, and a rotation part is formed at a lower portion of the cam part having a contact surface with the rod part.

In the present invention, the rotation part is configured as a ball which is freely rotatable in place.

In the present invention, the rotation part is configured and rotated in a roller type which is parallel to a ground surface and has a rotary axis vertical to a longitudinal direction of the cam part.

In the present invention, the rotation part is configured and rotated in a bearing type which is parallel to the ground surface and has the rotary axis vertical to the longitudinal direction of the cam part.

In the present invention, a seating groove to which the ball may be seated is further provided in at least one of the upper end of the rod part and the lower end of the cam part.

Specific matters including problems to be solved for the present invention, a solving means of the problems, and the effect of the invention for the present invention are included in exemplary embodiments and drawings to be described below. Advantages and features of the present disclosure, and methods for accomplishing the same will be more clearly understood from exemplary embodiments described in detail below with reference to the accompanying drawings.

Figure 1:
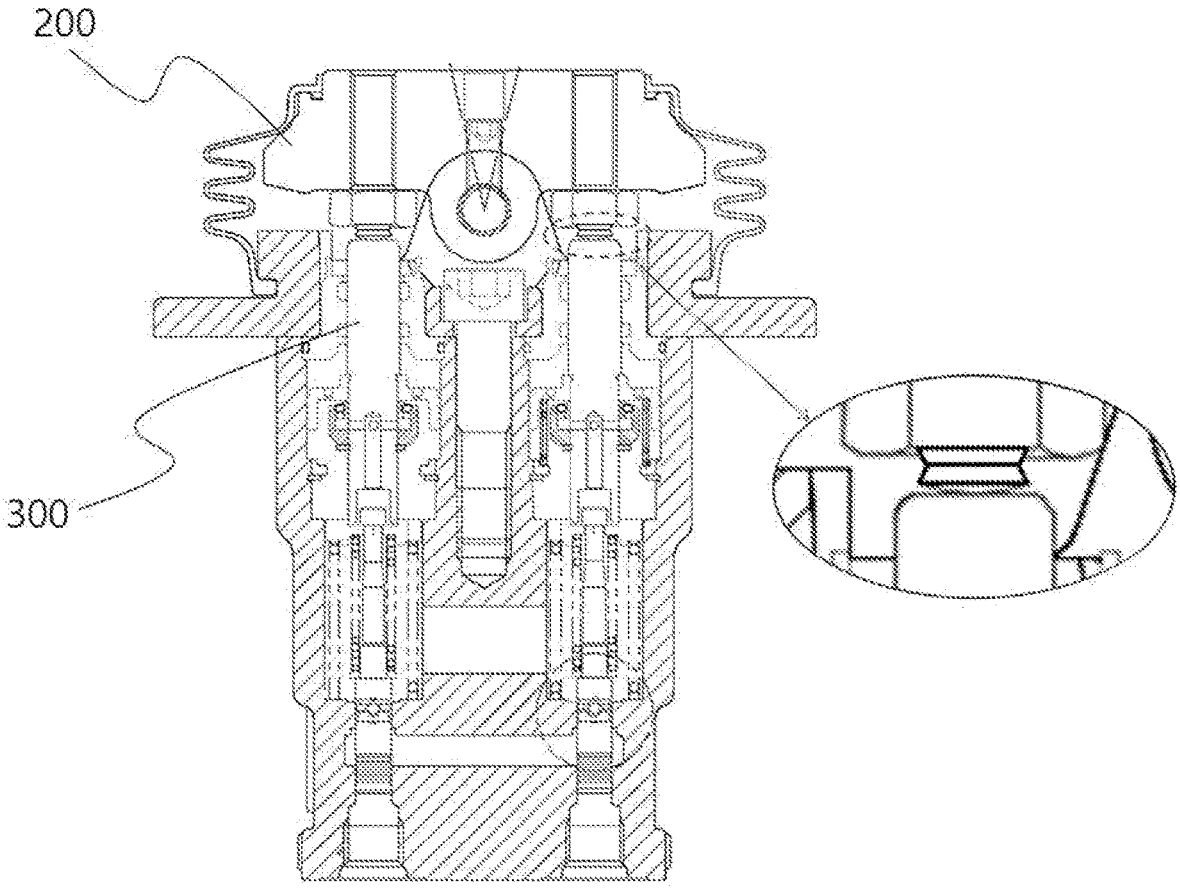
FIG. 1 is a side view of an excavator pedal valve in the related art.
Figure 2:
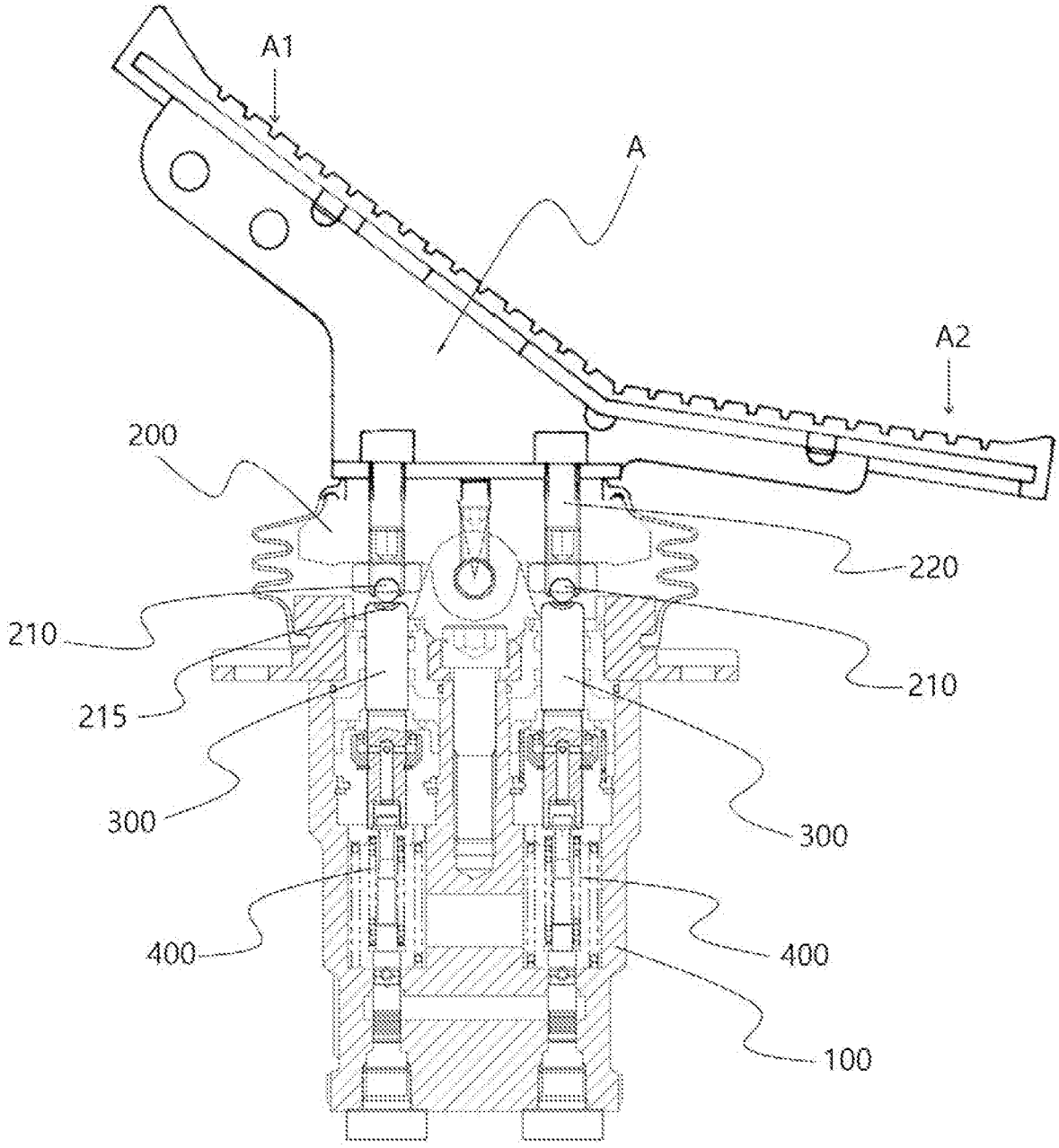
FIG. 2 is a side view illustrating a form in which an excavator pedal valve and a pedal are coupled to each other according to the present invention.
Figure 3:
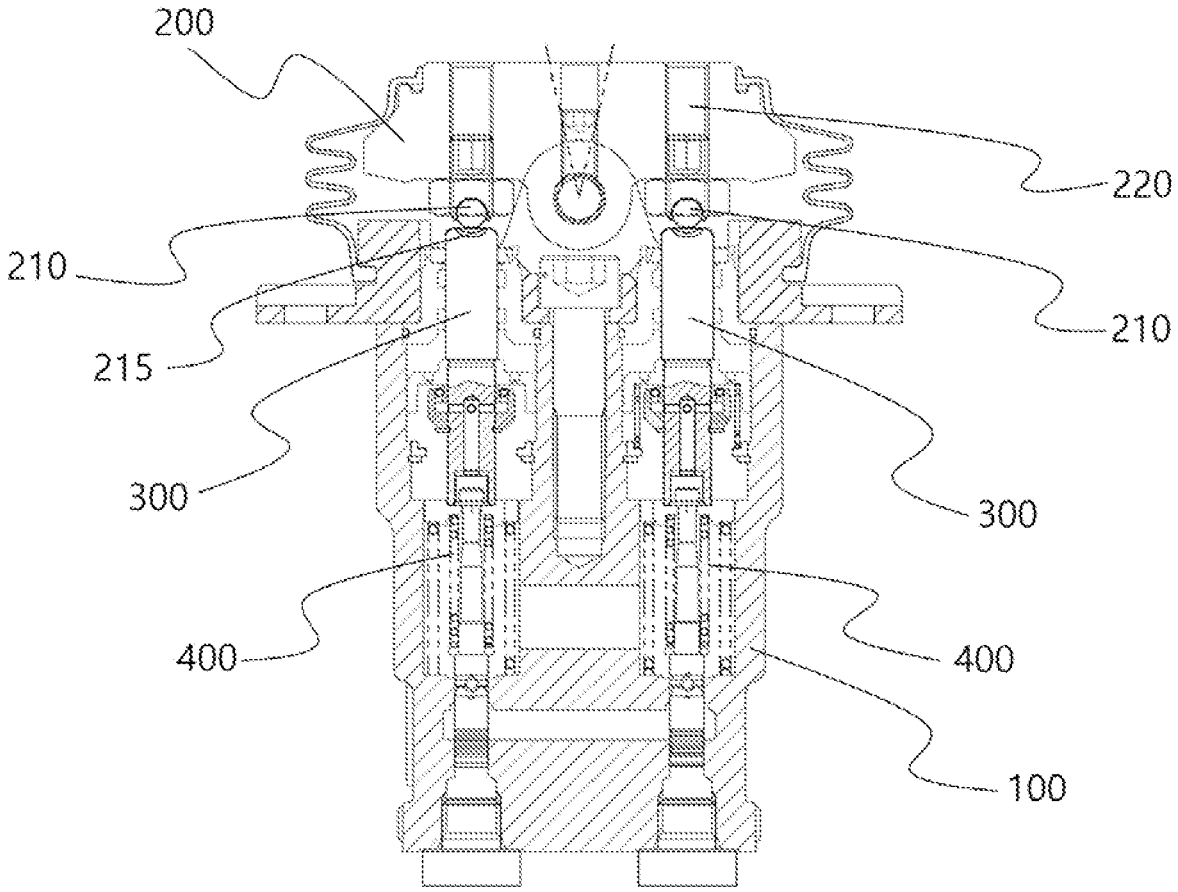
FIG. 3 is a side view illustrating a shape of the excavator pedal valve according to the present invention.
Figure 4:
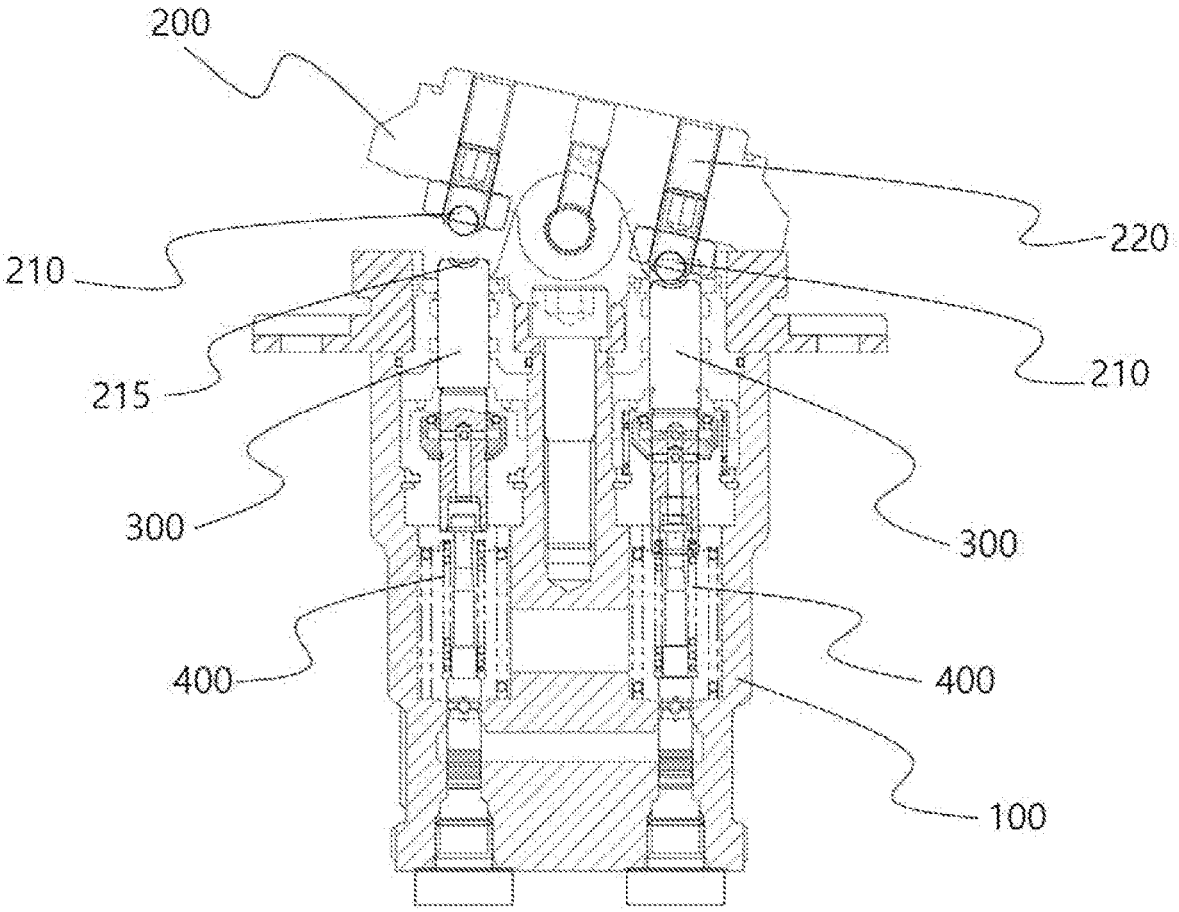
FIG. 4 is a side view illustrating a form in which pressure is applied to a rear of the excavator pedal valve according to the present invention.

As illustrated in FIGS. 1 to 3, an excavator pedal valve according to the present invention is configured to include a body part 100 in which a flow path for controlling forward and backward traveling is formed in a front and a rear of an interior in a vertical direction, a cam part 200 provided at an upper end of the body part 100 and provided so as to be rotatable in a forward direction A1 and a rear direction A2 with respect to a central axis by driving of a pedal A, a rod part 300 provided in each of a front lower portion and a rear lower portion of the cam part 200 to apply force in a vertical direction along the flow path of the body part 100, and a return elastic part 400 provided in a lower portion of the rod part 300 to return the rod part 300 upward.

First, in the body part 100, the flow path for controlling the forward and backward traveling is formed in the front and the rear in the body part 100 in the vertical direction.

The body part 100 as a part of a body of the excavator pedal A is provided with a hydraulic pressure passage for controlling the forward and backward traveling.

The flow path is formed in each of the front and the rear of the body part 100 in the vertical direction and when the pressure is applied to the hydraulic pressure formed in a front portion in the body part 100, forward traveling A1 may be performed and when the pressure is applied to the hydraulic pressure formed in a rear portion in the body part 100, backward traveling A2 may be performed.

The interior side of the body part 100 may be configured in any form as long as an operation for forward and backward traveling may be performed by the hydraulic pressure.

Next, the cam part 200 is provided at the upper end of the body part 100 and is provided so as to rotate back and forth about the central axis by driving the pedal A.

A lower central axis of the cam part 200 is hinged to the upper portion of the body part 100 so as to be rotatable toward a front lower portion A1 and a rear lower portion A2.

The central axis of the cam part 200 is coupled with the upper portion of the body part 100 by using DU BUSH, so that hinge rotation is advantageous.

The cam part 200 is inserted with a tongue bolt 220 having a hollow therein for coupling with the pedal A.

A nut is fastened to the lower portion of the tongue bolt 220 and the pressure is applied in such a manner that the lower portion of the tongue bolt 220 and the nut contact the upper end of the rod part 300.

In this case, the rotation part 210 may be coupled to the lower portion of the tongue bolt 220.

Specifically, the rotation part 210 as a component that applies the pressure in contact with the upper end of the rod part is configured by a rotation body that may rotate according to a pressure direction.

Figure 5A:
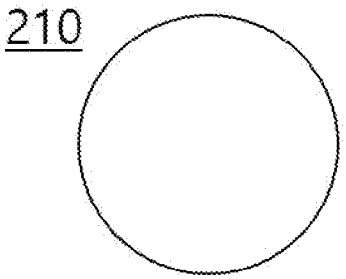
FIG. 5A illustrates a state in which a rotating part of the excavator pedal valve is configured by a ball according to the present invention.
Figure 5B:
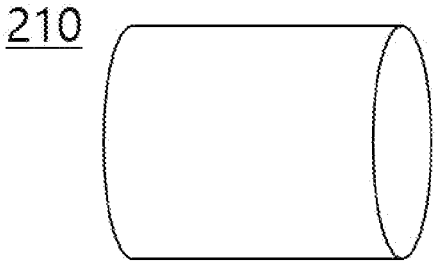
FIG. 5B illustrates a state in which the rotating part of the excavator pedal valve is configured by a roller according to the present invention.
Figure 5C:
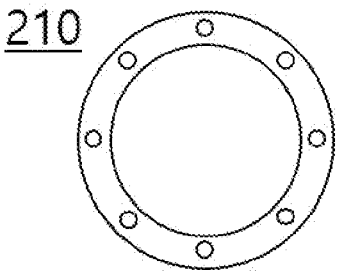
FIG. 5C illustrates a state in which the rotating part of the excavator pedal valve is configured by a bearing according to the present invention.

The rotation part 210 may be configured as a freely rotatable ball as illustrated in FIG. 5A, as a roller type which is parallel to a ground surface and has a rotary axis vertical to a longitudinal direction of the cam part as illustrated in FIG. 5B, and as a bearing having the same rotary axis as the roller as illustrated in FIG. 5C.

The rotation part 210 may be configured in any shape as long as it is rotatable in place in accordance with a direction in which the pressure is applied.

The upper surface of the rod part 300 is not damaged and the pressure may be softly applied by rotation of the cam part 200 when the pressure is applied to the rod part 300 because the rotation part 210 is in contact with the upper end of the rod part 300 described below.

Specifically, by rotating the rotary part 210 in the direction in which the pressure is applied, the frictional force of the frictional surface is minimized to minimize the occurrence of abrasion, and a pressure-affected portion is also replaced at any time to minimize damage to the frictional surface.

At this time, it is preferable that a groove-shaped seating groove 215 is formed at the lower end of the tongue bolt or the upper end of the rod part which is in contact with the rotation part 210.

By the seating groove 215, the rotation part is stably seated to transmit the pressure, and the rotation in a pressure direction may be facilitated.

Next, the rod part 200 is provided at EACH OF the front lower portion and the rear lower portion of the cam part 200 so as to exert force in the vertical direction along the flow path of the body part 100.

The rod part 300 is formed in the flow path inside the body part 100 so that the rod part 300 located at the front and the rear is configured to apply the pressure downward by the pressure depending on the rotation of the cam part 200.

The rod part 300 rotates downward to adjust the hydraulic pressure in the body part 100, thereby moving the excavator forward and backward.

Next, the return elastic part 400 is provided as an elastic body that is provided at the lower portion of the rod part 300 to return the rod part 300 upward.

The return elastic part 400 is provided with support points at the inside of the body part 100 and the lower portion of the rod part 300 to return the rod part 300 to an original location when the pressure of the rod part 300 is released.

The return elastic part 400 is provided as a compression spring to exert force to move the rod part 300 upward.

As described above, those skilled in the art will be able to understand that a technical configuration of the present invention can be easily executed in other detailed forms without changing the technical spirit or an essential feature thereof.

Therefore, the exemplary embodiments described as above are exemplary in all aspects and should be understood as not being restrictive and the scope of the present disclosure is represented by claims to be described below rather than the detailed description, and it is to be interpreted that the meaning and scope of the claims and all the changes or modified forms derived from the equivalents thereof come within the scope of the present invention.

What is claimed is:

1. An excavator pedal valve comprising:

a body part in which a flow path for controlling forward and backward traveling is formed in a front and a rear of an interior in a vertical direction;

a cam part provided at an upper end of the body part and provided so as to be rotatable in a forward direction and a rear direction with respect to a central axis by driving of a pedal;

a rod part provided in each of a front lower portion and a rear lower portion of the cam part to apply force in a vertical direction along the flow path of the body part; and a return elastic part provided in a lower portion of the rod part to return the rod part upward, wherein a rotation part is formed at a lower portion of the cam part having a contact surface with the rod part, wherein the rotation part is configured and rotated in a bearing which is parallel to a ground surface and has a rotary axis vertical to a longitudinal direction of the cam part.

2. An excavator pedal valve comprising:

a body part in which a flow path for controlling forward and backward traveling is formed in a front and a rear of an interior in a vertical direction;

a cam part provided at an upper end of the body part and provided so as to be rotatable in a forward direction and a rear direction with respect to a central axis by driving of a pedal;

a rod part provided in each of a front lower portion and a rear lower portion of the cam part to apply force in a vertical direction along the flow path of the body part; and a return elastic part provided in a lower portion of the rod part to return the rod part upward, wherein a rotation part is formed at a lower portion of the cam part having a contact surface with the rod part, wherein a seating groove to which a ball is seated is further provided in at least one of an upper end of the rod part and a lower end of the cam part.

* * * * *